United States Patent [19]

Goding

[11] Patent Number: 4,765,250

[45] Date of Patent: Aug. 23, 1988

[54] LOCOMOTIVE AND MOTORIZED SELF-STEERING RADIAL TRUCK THEREFOR

[75] Inventor: David J. Goding, Palos Park, Ill.

[73] Assignee: General Motors Corporation, Detroit, Mich.

[21] Appl. No.: 80,837

[22] Filed: Aug. 3, 1987

[51] Int. Cl.[4] ..... B61F 5/38

[52] U.S. Cl. ..... 105/166; 105/34.1; 105/172; 105/202

[58] Field of Search ..... 105/157.1, 165, 166, 105/167, 168, 171, 182.1, 185, 188, 189, 199.4, 199.1, 202, 211, 201, 34.1, 172, 136

[56] References Cited

U.S. PATENT DOCUMENTS

| | | | |
|---|---|---|---|
| 727,918 | 5/1903 | Ellery | 105/168 |
| 849,649 | 4/1907 | Wright | 105/157.1 |
| 1,142,379 | 6/1915 | Stevenson | 105/165 |
| 4,628,824 | 12/1986 | Goding et al. | 105/168 |
| 4,679,506 | 7/1987 | Goding et al. | 105/136 |
| 4,679,507 | 7/1987 | Rassaian | 105/168 |

*Primary Examiner*—Johnny D. Cherry
*Assistant Examiner*—Joseph D. Pape
*Attorney, Agent, or Firm*—Robert J. Outland

[57] ABSTRACT

An arrangement for locomotives and other railway vehicles having steerable or self-steering railway trucks, particularly motorized locomotive trucks, which incorporates axle height transfer of loads from the axles to the frame through connecting rods and steering beams connecting with the end axles. The steering beams are interconnected through upstanding torque tubes, cranks and a high level diagonal link extending over intermediate traction motors or other equipment. A bolsterless suspension of rubber pads supports the carbody with traction and braking loads being transferred through linkage including a carbody post carrying a short pivotally mounted carbody beam attached by connecting rods to an adjacent transom of the truck frame. The arrangement provides a compact and efficient force transfer system with low axle weight transfer while permitting interrelated self-steering action of the front and rear axles, but is also adaptable to forced steering truck arrangements.

7 Claims, 3 Drawing Sheets

LOCOMOTIVE AND MOTORIZED SELF-STEERING RADIAL TRUCK THEREFOR

TECHNICAL FIELD

This invention relates to railway vehicles and steering trucks therefor and, more particularly, to railway locomotives and motorized self-steering radial trucks for locomotive use.

BACKGROUND

Various types of steering railway trucks have been proposed wherein the angular positions of the axles and their associated wheels are allowed, or forced, to adjust during curve negotiation to maintain more or less radial positions with respect to the curve. Such arrangements are generally proposed to reduce friction and wear of the wheels and rails by minimizing lateral creep forces. The use of such trucks has been considered both for nonpowered railway cars and for locomotives with motorized axles.

An extended discussion of one such railway truck, intended primary for locomotive application, may be found in U.S. Pat. No. 4,628,824 issued Dec. 16, 1986 to the assignee of the present invention. This patent also contains an extensive list of prior art references. United States patents and applications setting forth additional features for self-steering railway trucks for use with locomotives and the like include U.S. Pat. Nos. 4,679,506 and 4,679,507, both issued July 14, 1987 and application Ser. No. 010,365 filed Feb. 3, 1987, all assigned to the assignee of the present invention.

U.S. Pat. No. 4,679,506 discloses an arrangement for powered three axle self-steering railway locomotive trucks. All axles are motorized and a steering beam pivoted on the frame is utilized as part of a linkage to interconnect the end axles for self-steering yaw motions of opposite sense and equal extent. This arrangement, together with those of U.S. Pat. No. 4,628,824 and application No. 010,365 may be considered as representing earlier arrangements in the development of the present invention.

SUMMARY OF THE INVENTION

The present invention provides a railway truck, and in particular embodiments a motorized self-steering railway locomotive truck, in association with a vehicle, or locomotive, carbody to provide additional features of construction and arrangement. These features may be useful in railway trucks generally and/or in self-steering railway trucks and motorized railway locomotive trucks of the forced-steering or self-steering types.

Among the features of the invention is a bolsterless construction in which the carbody is supported by resilient secondary suspension means directly on the railway truck frame and a force transmitting linkage connecting the frame with the carbody includes a carbody post pivotally supporting a relatively short carbody beam having laterally opposite ends, or points, which are connected longitudinally with an adjacent transom of the truck frame.

In another feature of the invention, steering beams connected with the end axles include upstanding torque tubes pivotally mounted on adjacent transoms. The torque tubes carry cranks which are connected by a link extending diagonally over an intermediate traction motor to interconnect the steering beams and the end axles to require self-steering yaw motions of opposite sense and equal extent.

These and other features and advantages of the invention will be more fully understood from the following description of a preferred embodiment of the invention taken together with the accompanying drawings.

BRIEF DRAWING DESCRIPTION

DETAILED DESCRIPTION

Figure 1:
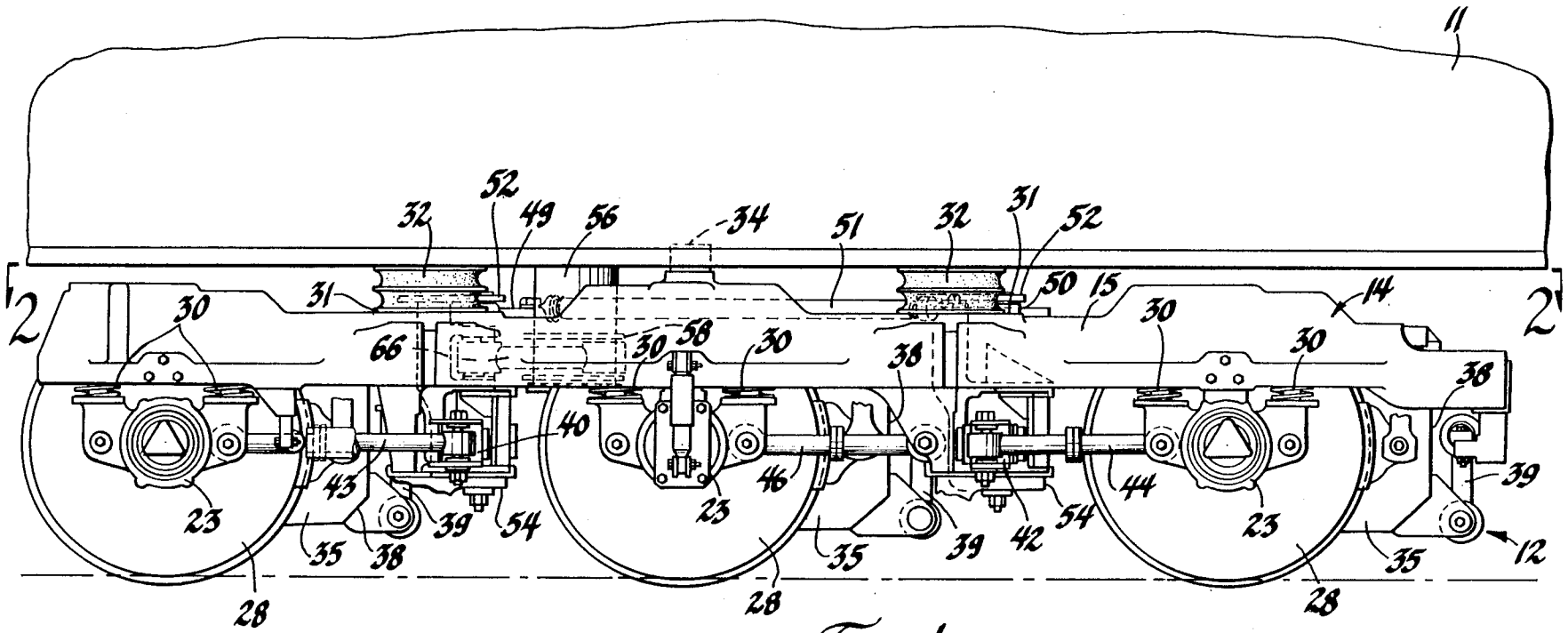
FIG. 1 is a side elevational view of a railway locomotive having a carbody supported at one end by a three axle self-steering motorized railway truck with features in accordance with the invention.
Figure 2:
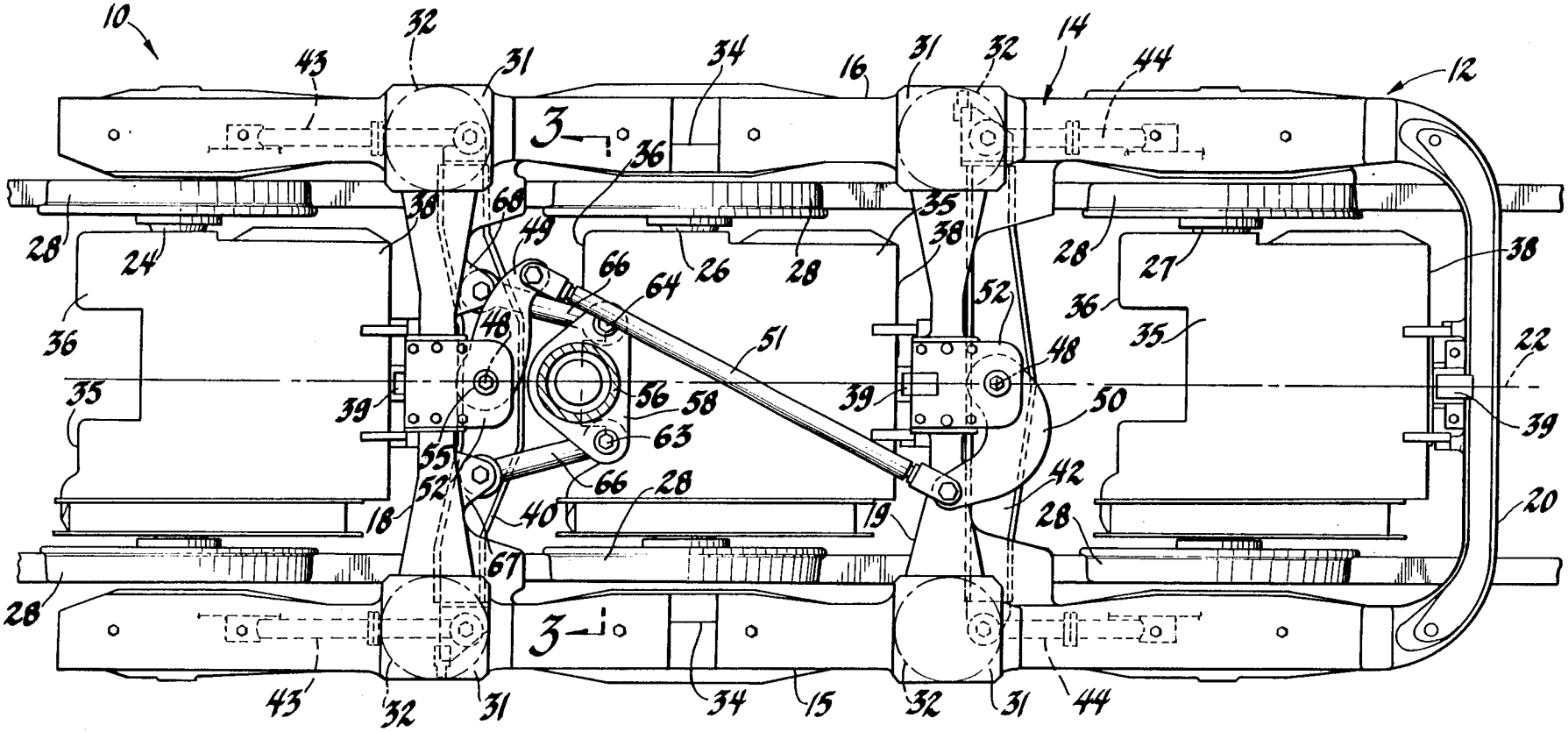
FIG. 2 is a cross-sectional view downward toward the top of the truck from the plane indicated by the line 2—2 of FIG. 1.
Figure 3:
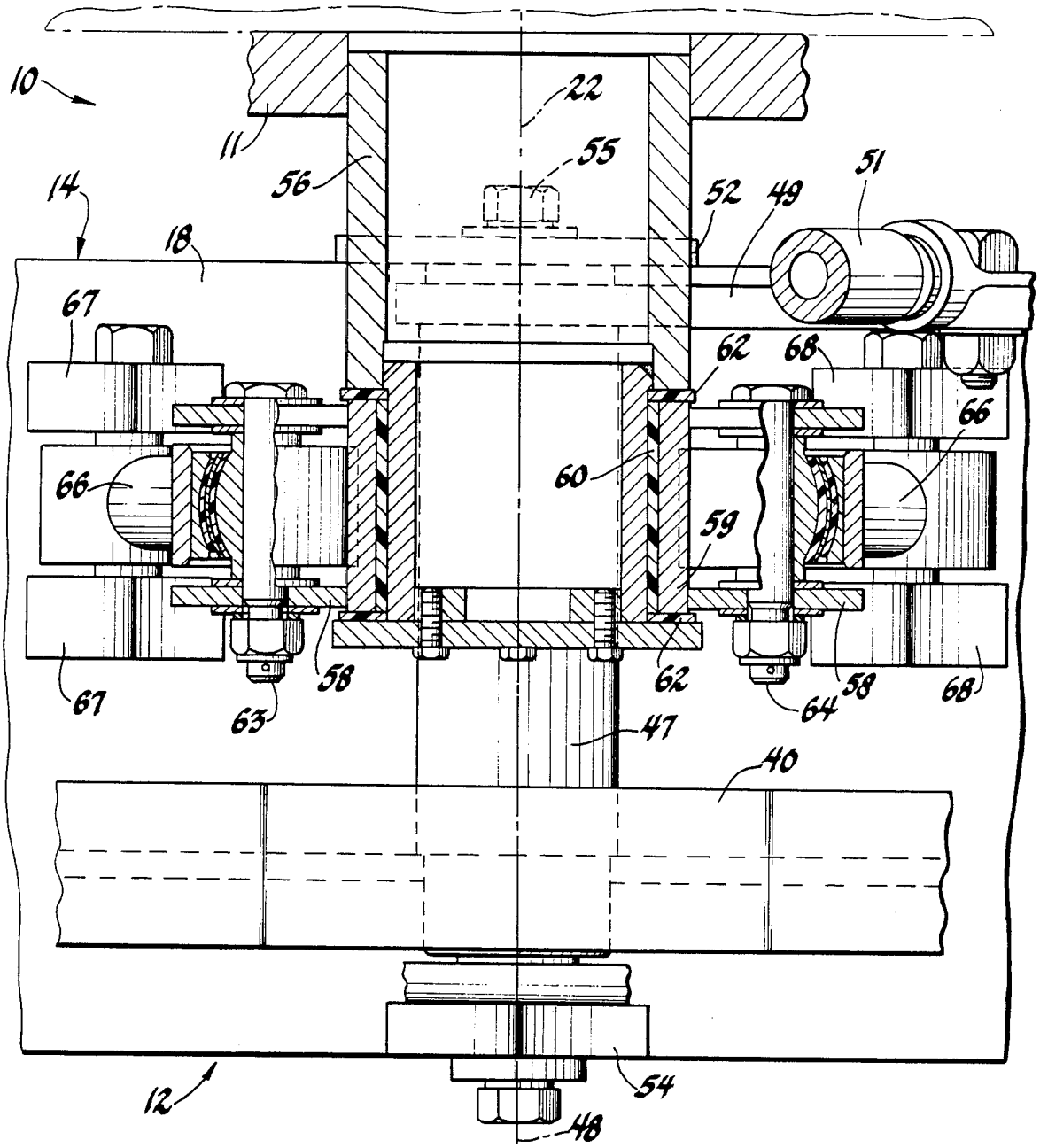
FIG. 3 is a transverse cross-sectional view showing the carbody and interaxle connections from the plane indicated by the line 3—3 of FIG. 2.

Referring now to the drawings in detail, numeral 10 generally indicates a self-powered railway locomotive having a carbody 11 supported at both ends by a motorized three axle self-steering railway truck generally indicated by numeral 12 and only one of which is shown. The truck 12 includes a unitary frame 14 which may be fabricated, cast or otherwise manufactured. The frame 14 includes a pair of generally parallel laterally spaced longitudinally extending side frames 15, 16 interconnected by three longitudinally spaced transversely extending transoms 18, 19, 20. A central longitudinal vertical plane 22 is located equidistant from the side frames 15 and 16.

At longitudinally spaced locations along the side frames 15, 16, the truck frame 14 is supported by primary suspension means. These include roller bearing adapters or housings 23 which are rotatably supported on the ends of front, center and rear axles 24, 26, 27 respectively carried by rail engageable wheels 28.

The wheels 28 are arranged in laterally spaced pairs each connected by one of the axles 24, 26, 27 to form longitudinally spaced wheel and axle assemblies. Preferably, the longitudinal spacing of the wheel and axle assemblies is equal, as illustrated, and the axles 24, 26, 27 are longitudinally spaced at equal distances from the transoms 18, 19, 20, respectively.

The primary suspension means further include resilient means, such as coil springs 30, which act between the bearing housings 23 and pockets in the truck frame 14 so as to support the truck frame. The springs 30 also allow limited relative motion of the wheel and axle assemblies with their bearing housings 23 while resiliently urging the housings and their wheel and axle assemblies into nominally centered noncurving longitudinally aligned positions.

Along the top of the truck side frames at the ends of the intermediate transoms 18 and 19 are four support pads 31 on which rubber springs 32 are carried for supporting the carbody 11. The rubber springs 32, which could be replaced by any other suitable resilient suspension means, are made stiff in compression to provide a relatively hard secondary suspension between the truck frame and carbody. The springs 32 yield more freely in sheer to permit limited lateral motion as well as yawing motion of the truck frame relative to the carbody during normal curve negotiation. Carbody stops 34, provided on the truck frame, are arranged to engage inner portions of the carbody to limit the amount of lateral carbody motion as required.

For powering the wheel and axle assemblies to drive the locomotive, the truck is provided with three traction motors 35, one driving each axle. Each motor has a forward side 36 supported by conventional bearing means on its respective axle and a rearward side 38 carried from one of the adjacent transoms by a depending link 39. The terms forward and rearward are used for descriptive purposes only as the truck may be operated equally well in either direction of operation. Each link 39 is flexibly or swively connected at its ends to allow a limited amount of both longitudinal and lateral motion between the traction motor and the adjacent transom member by which it is supported.

To provide for limited self-steering action of the wheel and axle assemblies while transmitting traction and braking forces between the wheel and axle assemblies and the truck frame, the truck is provided with suitable traction linkage formed in accordance with the invention. This traction linkage includes laterally extending front and rear steering beams 40, 42, respectively, which are pivotally connected at their centers with the bottoms of the intermediate transoms 18, 19, respectively, as will be subsequently more fully described.

Laterally opposite ends of the front and rear steering beams 40, 42 are, respectively, connected with the bearing housings 23 of the front and rear axles 24, 27 by front and rear traction rods 43, 44, respectively. The bearing housings 23 of the center axle 26 are directly connected with the truck frame by center traction rods 46 which allow lateral and vertical movement of the center axle but prevent any yawing or turning motion thereof.

The steering beams 40, 42 are attached to upstanding torque tubes 47 which extend vertically upward about the pivot axes 48 of the steering beams and connect, at their upper ends, with front and rear cranks 49, 50 respectively. These cranks extend in laterally opposite directions, the front crank 49 extending to the right and slightly backward from its steering beam pivot axis 48 and the rear crank 50 extending to the left and slightly forward from its steering beam pivot axis 48. The ends of the cranks are then interconnected by a link 51 which extends diagonally over the intermediate traction motor 35 which is located between the transoms 18, 19, is supported from the front side of the transom 19 and is drivingly connected with the center axle 26.

To support the steering beams with their associated torque tubes 47 and cranks 49, 50, the central transoms 18, 19 are provided with upper and lower pivot plates 52, 54, respectively, carrying through bolts 55. These secure internal steel and rubber bushings, not shown, on which the torque tubes 47 are pivotally mounted.

The steering beams 40, 42, connecting rods 43, 44 cranks 49, 50 and link 51 are so arranged as to require equal and opposite yawing (steering) motions of the front and rear axle assemblies so as to provide efficient inter-related self-steering actions of the end axles. These components, together with the center traction rods 46 connecting the center axle 26 with the frame, comprise first force transmitting linkage which carry the traction and braking forces between the axles and the truck frame, as well as allowing equal and opposite self-steering of the end axles.

The locomotive is further provided with second force transmitting linkage which connects the frame with the carbody to provide for the transfer of traction and braking forces therebetween. This linkage, or structure, includes a tubular carbody post 56 that depends from the carbody at a location centrally between the truck side frames and longitudinally disposed adjacent and slightly rearwardly of the front transom 18.

On the lower end of the post 56 there is carried a generally triangularly shaped carbody beam 58 having a cylindrical center 59 carried on a bearing bushing 60 and washers 62. The carbody beam 58 has pivot points 63, 64 at laterally opposite ends from which connecting rods 66 extend forwardly and outwardly to pivotal connections with ears 67, 68, respectively, located on the rear of the transom 18. The connecting rods are angled so as to allow yawing motions of the truck frame about the carbody post 56 to effectively take place approximately about a center equidistant from the four rubber springs 32 on which the carbody is supported.

The transfer of forces from the truck frame to the carbody through the connecting rods 66, carbody beam 58 and carbody post 56 permits a locomotive truck arrangement having the advantages of bolsterless construction and using rubber springs 32 to support the vertical loads while allowing normal yawing and lateral motion of the truck frame relative to the carbody during operation. The additional provision of the steering linkage, utilizing connecting rods to transfer axle loads to the steering beams and the truck frame at axle level, combines with the vertically stiff secondary suspension to provide low weight transfer between axles during operation.

Interconnection of the axles through the steering beams by means of the upstanding torque tubes 47, cranks 49, 50 and link 51 provides the desired steering interconnection of the axles within space made available by the absent bolster. The high level of the diagonal link 51, positioned over or near the tops of the frame transoms 18, 19, allows it to extend over the top of the central traction motor 35. This avoids any need for increasing the overall width of the truck as is done in the linkage arrangement of U.S. Pat. No. 4,679,506, previously mentioned.

The traction motors are conventionally supported on their respective axles and on the front sides of the adjacent transoms 18, 19, 20. The steering beams 40, 42 and their associated torque tubes 47 are, accordingly, carried on the rear sides of the associated intermediate transoms 18 and 19, taking advantage of the available open sides opposite from the supporting points of the adjacent traction motors.

These various features provide a railway vehicle and supporting truck arrangement having self-steering capability, as described in the previously mentioned patent and applications, and with the further benefits of compactness and practicality for multi-axle locomotive trucks, especially those having three or more axles. While the arrangement is disclosed in connection with self-steering trucks, it should be understood that features of the arrangement could also be applied to so called forced steering railway trucks wherein the steering mechanism is interconnected directly with the vehicle or locomotive carbody to interrelate the steering movements of the axles with the yawing motion of the truck frame relative to the carbody. Thus, while the described arrangement is free of direct connections between the steering linkage and the carbody, the features of the invention are not so limited.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. A railway locomotive of the type comprising a carbody supported by a self steering truck including a pair of wheel and axle members, a truck frame including a pair of parallel side frames interconnected by at least one laterally extending transom, the truck frame being carried by the axles through resilient suspension means nominally urging the axles into centered positions for motion along straight track but permitting yawing for movement along curved track, traction motors drivingly connected with the axles for driving the locomotive wheels, one of the motors being carried on a side of said transom, first force transmitting linkage connecting the axles with the frame and including a lateral steering beam connected with at least one of the axles and having a center pivotally connected with the frame and free from connection with the carbody to allow self steering of its connected axle while carrying longitudinal forces between it and the frame, and second force transmitting linkage connecting the frame with the carbody and including the improvement of a carbody post depending from the carbody laterally between the truck side frames and longitudinally adjacent to said at least one transom on the opposite side from said one of the motors, a carbody beam pivotally carried on the post and having laterally opposite ends each lying between the post and one of the side frames, and movably attached connecting rods longitudinally connecting each of said carbody beam ends with the adjacent transom to carry traction and braking forces while allowing yawing and lateral motion of the truck frame relative to the carbody.

2. A railway locomotive as in claim 1 wherein the carbody is supported on the truck frame by resilient secondary suspension means spaced laterally toward opposite sides of the truck frame, the truck includes at least three wheel and axle members each driven by a connected traction motor, the truck frame includes two of said transoms each supporting one of the traction motors and spaced one between each of the end axles and the remaining axles, and the first force transmitting linkage includes a pair of said steering beams connected one with each of the end axles, means interconnecting said steering beams to require self steering yaw motions of the wheel and axle members to be of opposite sense and equal extent and the further improvement wherein said interconnecting means includes a torque tube upstanding from each of the steering beams and pivotally mounted on one of the transoms with a crank on the tube above its respective steering beam, the cranks of the two beams extending in laterally opposite directions, and a link connecting the two cranks for equal and opposite oscillation, said link extending diagonally over the at least one intermediate traction motor to interconnect the steering beams.

3. A railway locomotive of the type comprising a carbody supported by a self steering truck including at least three longitudinally spaced wheel and axle members, a truck frame including a pair of parallel side frames interconnected by two laterally extending transoms each spaced longitudinally between one of the end axles and the remaining axles, the truck frame being carried by the axles through resilient primary suspension means nominally urging the axles into centered positions for motion along straight track but permitting yawing for movement along curved track, the carbody being supported on the truck frame by resilient secondary suspension means spaced laterally toward the side frames, traction motors drivingly connected with the axles for driving the locomotive wheels, two of the motors being carried on sides of the transoms, first force transmitting linkage connecting the axles with the frame and including a pair of lateral steering beams connected one with each of the end axles and each beam having a center pivotally connected with the frame and free from connection with the carbody to allow self steering of its connected axle while carrying longitudinal forces between it and the frame, means interconnecting said steering beams to require self steering yaw motions of the wheel and axle members to be of opposite sense and equal extent and the improvement wherein said interconnecting means includes a torque tube upstanding from each of the steering beams and pivotally mounted on one of the transoms with a crank on the tube above its respective steering beam, the cranks of the two beams extending in laterally opposite directions, and a link connecting the two cranks for equal and opposite oscillation, said link extending diagonally over the at least one intermediate traction motor to interconnect the steering beams.

4. A railway locomotive of the type comprising a carbody supported by a steering truck including a pair of wheel and axle members, a truck frame including a pair of parallel side frames interconnected by at least one laterally extending transom, the truck frame being carried by the axles through primary suspension means permitting yawing for movement along curved track, first force transmitting linkage connecting the axles with the frame and including a lateral steering beam connected with at least one of the axles and having a center pivotally connected with the frame to allow steering of its connected axle while carrying longitudinal forces between it and the frame, and second force transmitting linkage connecting the frame with the carbody and including the improvement of a carbody post depending from the carbody laterally between the truck side frames and longitudinally adjacent to said at least one transom, a carbody beam pivotally carried on the post and having laterally opposite points each lying between the post and one of the side frames, and movably attached connecting rods longitudinally connecting each of said carbody beam points with the adjacent transom to carry traction and braking forces while allowing yawing and lateral motion of the truck frame relative to the carbody.

5. A railway locomotive as in claim 4 wherein the carbody is supported on the truck frame by resilient secondary suspension means spaced laterally toward opposite sides of the truck frame, the truck includes at least three wheel and axle members, the truck frame includes two of said transoms spaced one between each of the end axles and the remaining axles, and the first force transmitting linkage includes a pair of said steering beams connected one with each of the end axles, means interconnecting said steering beams to require self steering yaw motions of the wheel and axle members to be of opposite sense and equal extent and the further improvement wherein said interconnecting means includes a torque tube upstanding from each of the steering beams and pivotally mounted on one of the transoms with a crank on the tube above its respective steering beam, the cranks of the two beams extending in laterally opposite directions, and a link connecting the two cranks for equal and opposite oscillation, said link extending diagonally over the portion intermediate the transoms to interconnect the steering beams.

6. A railway locomotive steering truck including a pair of wheel and axle members, a truck frame including a pair of parallel side frames interconnected by at least two laterally extending transoms, the truck frame being carried by the axles through primary suspension means permitting yawing for movement along curved track, first force transmitting linkage connecting the axles with the frame and including a pair of lateral steering beams, one connected with each of the two axles and each having a center pivotally connected with the frame to allow steering of its connected axle while carrying longitudinal forces between it and the frame, and means interconnecting said steering beams to require self steering yaw motions of the wheel and axle members to be of opposite sense and equal extent and the improvement wherein said interconnecting means includes a torque tube upstanding from each of the steering beams and pivotally mounted on one of the transoms with a crank on the tube above its respective steering beam, the cranks of the two beams extending in laterally opposite directions, and a link connecting the two cranks for equal and opposite oscillation, said link extending diagonally over the portion intermediate the transoms to interconnect the steering beams.

7. A railway locomotive of the type comprising a carbody supported by a self steering truck including at least three longitudinally spaced wheel and axle members, a truck frame including a pair of parallel side frames interconnected by two laterally extending transoms each spaced longitudinally between one of the end axles and the remaining axles, the truck frame being carried by the axles through primary suspension means permitting yawing for movement along curved track, the carbody being supported on the truck frame by resilient secondary suspension means spaced laterally toward the side frames, traction motors drivingly connected with the axles for driving the locomotive wheels, first force transmitting linkage connecting the axles with the frame and including a pair of lateral steering beams connected one with each of the end axles and each beam having a center pivotally connected with the frame for carrying longitudinal forces between it and the frame, means interconnecting said steering beams to require self steering yaw motions of the wheel and axle members to be of opposite sense and equal extent and the improvement wherein said interconnecting means includes a torque tube upstanding from each of the steering beams and pivotally mounted on one of the transoms with a crank on the tube above its respective steering beam, the cranks of the two beams extending in laterally opposite directions, and a link connecting the two cranks for equal and opposite oscillation, said link extending diagonally over the at least one intermediate traction motor to interconnect the steering beams.

* * * * *